US005285362A

United States Patent [19]

Sakata

[11] Patent Number: 5,285,362

[45] Date of Patent: Feb. 8, 1994

[54] DISCHARGE LAMP HAVING INTERFERENCE FILTER

[75] Inventor: Masao Sakata, Kanagawa, Japan

[73] Assignee: Nissan Motor Co., Ltd., Yokohama, Japan

[21] Appl. No.: 941,604

[22] Filed: Sep. 8, 1992

[30] Foreign Application Priority Data

Sep. 9, 1991 [JP] Japan ..... 3-227928

[51] Int. Cl.[5] ..... F21V 9/00

[52] U.S. Cl. ..... 362/263; 362/61; 362/293; 359/589

[58] Field of Search ..... 362/293, 261, 61, 351, 362/308, 263; 313/639, 112; 359/589, 577, 580, 581, 586, 588

[56] References Cited

U.S. PATENT DOCUMENTS 2,413,127 12/1946 Wells ..... 362/268
4,940,636 7/1990 Brock et al. ..... 359/586
5,109,181 4/1992 Fischer et al. ..... 313/639
5,169,224 12/1992 Segoshi et al. ..... 362/263

FOREIGN PATENT DOCUMENTS 61-87106 5/1986 Japan .
2-256153 10/1990 Japan .
9119938 12/1991 PCT Int'l Appl. ..... 362/293

*Primary Examiner*—Ira S. Lazarus
*Assistant Examiner*—L. Heyman
*Attorney, Agent, or Firm*—Lowe, Price, LeBlanc & Becker

[57] ABSTRACT

A metal halide lamp device includes a discharge bulb and a light filter. The light filter is constructed such that transmittance of about 436 nm wavelength light-rays passing through the light filter and transmittance of about 546 nm wavelength light-rays passing therethrough are made substantially lower, and transmittance of about 578 nm wavelength light-rays passing therethrough is made substantially high. Due to the provision of the light filter, a bluish color during a starting period of the discharge bulb is transformed into a substantially white color.

11 Claims, 5 Drawing Sheets

DISCHARGE LAMP HAVING INTERFERENCE FILTER

BACKGROUND OF THE INVENTION

1. Field of the Invention

The present invention relates to a discharge lamp, and more particularly, to a metal halide lamp of a type equipped with a light filter for removing incident light rays of certain wavelengths.

2. Description of the Prior Art

A metal halide lamp device has a discharge bulb which contains therein mercury and metal halides such as sodium halide, scandium halide and tin halide emitting light rays therefrom. During start-up period with several tens of seconds after the discharge bulb has been energized, light rays radiating from the discharge bulb have a poor color rendition. That is, light rays radiating from the discharge bulb have a bluish color which is characteristic of radiation from mercury. The reason for this is that the interior of the discharge bulb has a relatively low temperature during the start-up period so that light rays are predominantly radiated from mercury. As is shown by a solid line "a" of FIG. 1, a relative spectral distribution of light rays radiating from the discharge bulb during the start-up period is confined to four discrete wavelengths, i.e. 405 nm, 436 nm, 546 nm and 578 nm wavelengths, in the visible portion (380 nm to 720 nm) of the spectrum. It is noted that a plurality of monochromatic light rays which are 405 nm, 436 nm, 546 nm and 578 nm wavelength have colors of violet, blue, green and yellow, respectively. This combination of the four wavelengths makes light rays bluish in color during the start-up period.

In a steady state of the discharge bulb, i.e. after the start-up period of the same, as the bulb warms up, light rays are radiated from the above-mentioned metal halide molecules or from metals of the same. As is shown by a dotted line "b" of FIG. 1, light rays radiating from the discharge bulb during the steady state are composed of relatively many different wavelengths, i.e. a relatively continuous spectrum as compared with the spectrum of light rays during the start-up period. Therefore, light rays under the steady state of the discharge bulb which are composed of a combination of different wavelengths, have a superior color rendition, i.e. white or at least whitish in color.

In view of the above-mentioned characteristics of the metal halide lamp, there are proposals to improve color rendition of the discharge bulb, i.e. to give off light rays of a white color during its start-up period.

For example, Japanese Patent First Publication Hei-2-256153 discloses a metal halide lamp device which is equipped with a multi-layer interference film or a high-pass filter for radiating light rays of a low color temperature and for improving color rendition. However, this device is still unsatisfactory in improving color rendition during the start-up period. In fact, this device radiates light rays which are greenish in color, because the interference filter is designed to remove light rays of wavelength shorter than about 500 nm, and thus the filter can not sufficiently remove light rays of 546 nm (green) wavelength.

When the metal halide lamp device is used as an automotive headlamp, it is turned on and off frequently in some cases. That is, it is repeatedly and intermittently kept in the start-up period. Thus, if color rendition of the metal halide lamp device is poor, it makes the driver's eyes tired.

SUMMARY OF THE INVENTION

It is therefore an object of the present invention to provide a metal halide lamp device which has a light filter so as to improve color rendition during its start-up period.

It is another object of the present invention to provide a metal halide lamp device in which light intensity reduction due to the provision of the light filter is minimized during a steady state of the device.

According to the present invention, there is provided a metal halide lamp device including: a discharge bulb containing therein mercury and at least one metal halide, the discharge bulb being adapted to radiate light rays of a bluish color during a start-up period thereof after energization, the light rays during the start-up period being predominantly emitted from the mercury and having a relative spectral distribution which is confined to discrete wavelengths of about 405 nm, about 436 nm, about 546 nm and about 578 nm; and a light filter which is so constructed such that transmittance of about 436 nm wavelength light-rays passing through the light filter and transmittance of about 546 nm wavelength light-rays passing therethrough are made lower than transmittance of about 578 nm wavelength light-rays passing therethrough, thereby transforming the bluish color into a substantially white color by passing the light rays through the light filter.

DESCRIPTION OF THE PREFERRED EMBODIMENTS

A metal halide lamp device according to the present invention has a discharge bulb which contains therein mercury and metal halides such as sodium halide, scandium halide and tin halide, so as to give off light rays therefrom. This discharge bulb has the same characteristics as those of the above-mentioned conventional one. That is, the discharge bulb of the present invention also radiates light rays of a bluish color during its start-up period and light rays of a white color during its steady state. It should be noted that light rays of 436 nm (blue) and 546 nm (green) wavelength mainly contribute to make light rays bluish in color during the start-up period. It should be still noted that human eyes are not so sensitive to light rays of 405 nm (violet) wavelength as compared to those of 436 nm and 546 nm wavelength. Therefore, the contribution of light rays of 405 nm wavelength to make the light rays bluish is negligible.

Figure 1:
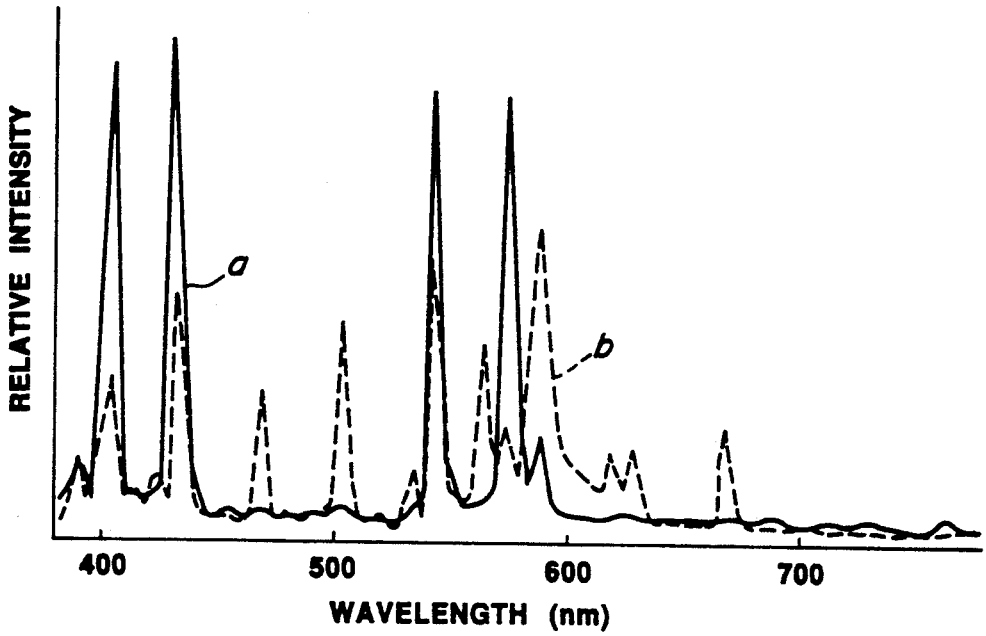
FIG. 1 is a graph showing a spectral distribution of light rays radiated from a discharge bulb during its start-up period by a solid line "a", and another spectral distribution of light rays radiated from the discharge bulb during its steady state by a dotted line "b"

As is shown by a solid line "a" of FIG. 1, light rays during the start-up period has a spectral distribution which are composed of 405 nm, 436 nm, 546 nm and 578 nm wavelengths. This spectrum which is characteristic of radiation from mercury makes light rays bluish in color during the start-up period.

According to the present invention, there is provided a light-filter film which is so constructed such that transmittance of light rays of about 436 nm (blue) and about 546 nm (green) wavelength are set lower than transmittance of light rays of about 578 nm (yellow) wavelength by a certain predetermined degree. With this, light rays during the start-up period are made white or at least whitish in color as compared with the original bluish light rays radiated from the discharge bulb. Furthermore, the light-filter film of the present invention is so constructed as to increase transmittance of light rays of wavelength between 436 nm and 546 nm and to increase transmittance of light rays of wavelength greater than 546 nm. With this, as is shown by a dotted line "b" of FIG. 1, transmittance of light rays of two specific wavelengths, i.e. about 470 nm and about 510 nm, and transmittance of light rays of relatively continuous wavelengths greater than 546 nm, are set high during the steady state. Therefore, light rays transmitted by the light-filter film can have a high intensity during the steady state.

It is noted that the light-filter film having the above characteristics can be constructed if all of the following three requirements are fulfilled with respect to transmittance of light rays passing through the light-filter film.

A first requirement is that the transmittance takes local minimum values at about 436 nm and at about 546 nm in wavelength, respectively.

A second requirement is that the transmittance takes a local maximum value at about 480 nm which is positioned midway between 436 nm and 546 nm in wavelength.

A third requirement is that the transmittance of light rays of wavelength greater than about 546 nm is higher than that of light rays of about 436 nm wavelength.

The light-filter film according to the present invention is, in fact, a type of interference filters in which light rays of a certain wavelength are removed by interference phenomena. Therefore, the transmittance increases if the following equation (1) is satisfied:

$$4n \cdot d/\lambda_a = 2\,k_0 \qquad (1)$$

wherein, "d" represents thickness of the light-filter film, "n" represents refractive index of the light-filter film, "$\lambda_a$" represents wavelength of light rays of which transmittance is to be increased, and "$k_0$" represents an integer.

On the other hand, the transmittance decreases if the following equation (2) is satisfied:

$$4\,n \cdot d/\lambda_b = 2\,k_1 + 1 \qquad (2)$$

wherein, "$\lambda_b$" represents wavelength of light rays of which transmittance is to be decreased, and "$k_1$" represents an integer.

The following equation (3) is obtained by substituting 480 (nm) for "$\lambda_a$" of the equation (1).

$$n \cdot d = 240 \cdot k_0 \qquad (3)$$

The following equation (4) is obtained by an equivalent transformation of the equation (2).

$$\lambda_b = 4\,n \cdot d/(2\,k_1 + 1) \qquad (4)$$

The following equation (5) is obtained by substituting the equation (3) for the equation (4).

$$\lambda_b = 960\,k_0/(2\,k_1 + 1) \qquad (5)$$

Therefore, the actual values of "$\lambda_b$" can be determined by substituting the actual integral numbers for "$k_0$" and "$k_1$". Thus, the values of "$\lambda_b$" are shown in the Table.

TABLE

| $k_0$ \ $k_1$ | 2 | 3 | 4 | 5 | 6 | 7 | 8 |
|---|---|---|---|---|---|---|---|
| 1 | 640 | 960 | 1280 | 1600 | 1920 | 2240 | 2560 |
| 2 | 384 | 576 | 768 | 960 | 1152 | 1344 | 1536 |
| 3 | 274 | 441 | 549 | 686 | 823 | 960 | 1097 |
| 4 | 213 | 320 | 427 | 533 | 640 | 747 | 852 |
| 5 | 175 | 262 | 349 | 436 | 524 | 611 | 698 |
| 6 | 148 | 222 | 259 | 369 | 443 | 517 | 591 |
| 7 | 128 | 192 | 256 | 320 | 384 | 448 | 512 |
| 8 | 113 | 169 | 226 | 282 | 339 | 395 | 452 |

As is shown in the Table, the combinations of ($k_0$, $k_1$) for fulfilling the above-mentioned first requirement are (4, 3), (4, 4), (5, 4), (5, 5), (6, 5), and (6, 6). That is, with these combinations of ($k_0$, $k_1$), the transmittance of light rays decreases at about 436 nm and about 546 nm wavelength. The values of $k_0$, i.e. 4, 5 and 6, are respectively substituted for the equation (3). With this, the products of "n" and "d" are found as follows.

$$n \cdot d = 960,\ 1200,\ 1440$$

It is noted that certain adjustment ranges of the products of "n" and "d" are necessary to be taken so as to satisfy the above-mentioned third requirement. For example, the adjustment ranges can be taken as follows.

$$n \cdot d = 960 \pm 70,\ 1200 \pm 90,\ 1440 \pm 100$$

Thus, the light-filter film according to the present invention is produced so as to allow the products of "n" and "d" to fall within one of the three adjustment ranges from 890 nm to 1030 nm, from 1110 nm to 1290 nm, and from 1340 nm to 1540 nm. With this, transmittance of light rays of 436 nm and 546 nm wavelength are set lower than that of light rays of 578 nm, thereby producing light rays which have a white or whitish color during the starting period. Furthermore, according to the present invention, transmittance of light rays of wavelength between 436 nm and 546 nm and that of wavelength greater than 546 nm are kept high, thereby minimizing light intensity reduction due to the provision of the light-filter film, during the steady state.

It should be noted that the above-mentioned three adjustment ranges of the products of "n" and "d" are provided on condition that light rays incident on the light-filter film has an incident angle of 0 degree, i.e. the incident light rays are arranged perpendicular to the surface of the light-filter film.

Referring to FIGS. 2 to 7, a metal halide lamp device according to a first embodiment of the present invention will be described in the following.

Figure 2:
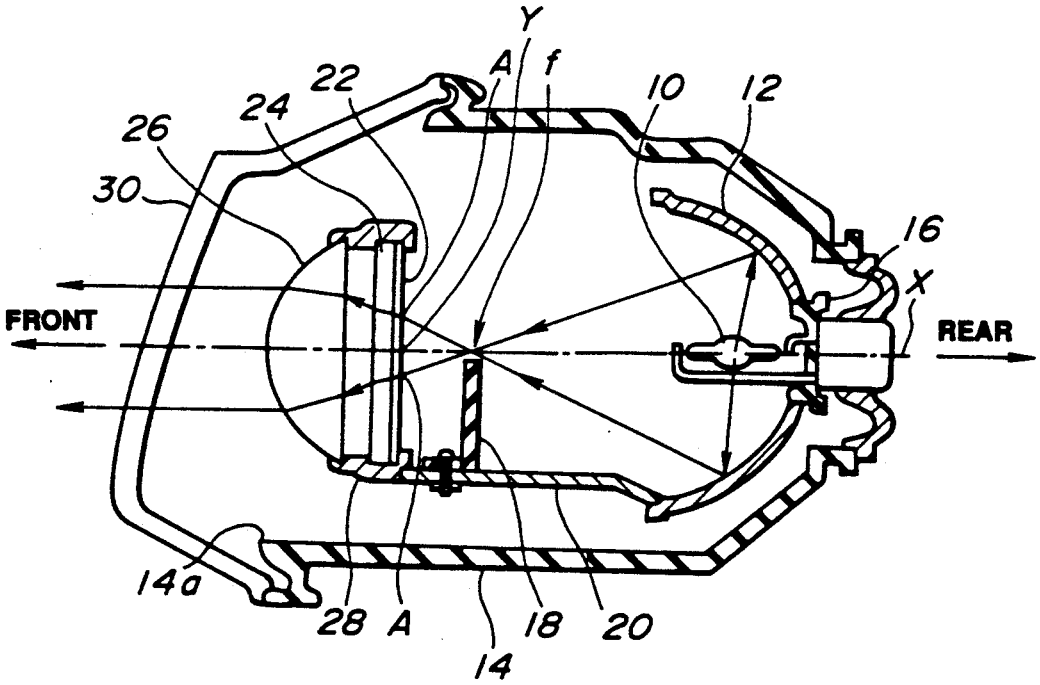
FIG. 2 is a sectional view showing a metal halide lamp device according to a first embodiment of the present invention.

As is seen from FIG. 2, the metal halide lamp of the present invention is used, for example, as an automotive head lamp. Designated by numeral 10 is a discharge bulb which is disposed on a central axis "X" of an ellipsoidal reflector 12. The discharge bulb 10 is connected to the reflector 12 and a housing 14 through a base 16. The discharge bulb 10 is also connected to a known drive circuit (not shown) for energizing the discharge bulb 10 so as to radiate light rays therefrom. There is provided a shade 18 for partially shading light rays which have been reflected by the reflector 12. An upper end of the shade 18 is positioned very close to a focus "f" of the reflector 12. The shade 18 is securely connected to a first support member 20 which is secured to a lower end portion of the reflector 12. A major portion of the shade 18 is arranged perpendicular to the first support member 20.

Figure 3:
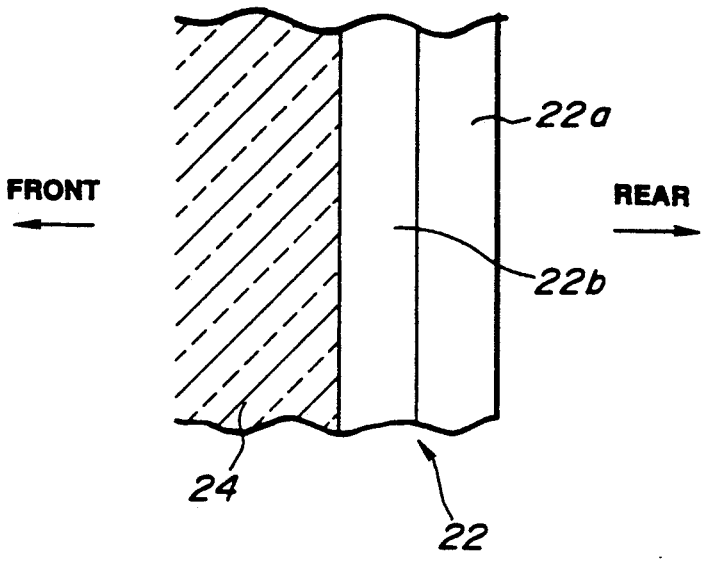
FIG. 3 is an enlarged sectional view showing first and second layers of a light-filter film and a glass plate, in accordance with the first embodiment.

As is seen from FIGS. 2 and 3, first and second layers 22*a* and 22*b* of a light-filter film 22 are formed on a glass plate 24 by a vacuum deposition method, a sputtering method, a dipping method, or the like. The light-filter film 22 is made of $SiO_2$, $TiO_2$, or a mixture of $SiO_2$ and $TiO_2$.

As is seen from FIG. 2, the glass plate 24 having thereon the first and second layers 22*a* and 22*b* of the light-filter film 22 is disposed ahead of the shade 18, and arranged perpendicular to the central axis "X" of the reflector 12.

A converging lens 26 is positioned ahead of the glass plate 24 so as to align a central axis of the converging lens 26 with the central axis "X" of the reflector 12. The converging lens 26, the glass plate 24 and the light-filter film 22 are connected to the first support member 20 through a second support member 28.

A transparent front cover 30 is secured to the housing 14 so as to hermetically close a front opening 14*a* of the housing 14.

When the drive circuit is closed, light rays are radiated from the discharge bulb 10. Radiated light rays directed toward the reflector 12 are reflected by the same and converged at the focus "f" of the reflector 12.

As is mentioned hereinabove, light rays of about 436 nm and about 546 nm wavelength are substantially removed by the light-filter film 22. Then, light rays pass through the converging lens 26 so as to produce parallel light rays which are projected forward from the converging lens 26. Then, light rays pass through the front cover 30 in the forward direction of the automobile.

Referring to the above-mentioned adjustment ranges of the products of "n" and "d", the first and second layers 22*a* and 22*b* of the light-filter film 22 of the present invention are constructed so as to satisfy the following equation (6):

$$n_1 \cdot d_1 + n_2 \cdot d_2 = 960 \pm 70,\ 1200 \pm 90,\ 1440 \pm 90 \qquad (6)$$

wherein "$n_1$" and "$d_1$" represent refractive index and thickness of the first layer 22*a* of the light-filter film 22 respectively, and "$n_2$" and "$d_2$" represent refractive index and thickness of the second layer 22*b* of the light-filter film 22 respectively.

For example, the values of 1.6 and 160 nm are respectively taken as "$n_1$" and "$d_1$", and the values of 2.4 and 390 nm are respectively taken as "$n_2$" and "$d_2$". In this case, the sum of the products of "$n_1$" and "$d_1$" and the products of "$n_2$" and "$d_2$" equals to 1192 which is in the adjustment range of 1200±90 of the equation (6).

Figure 4:
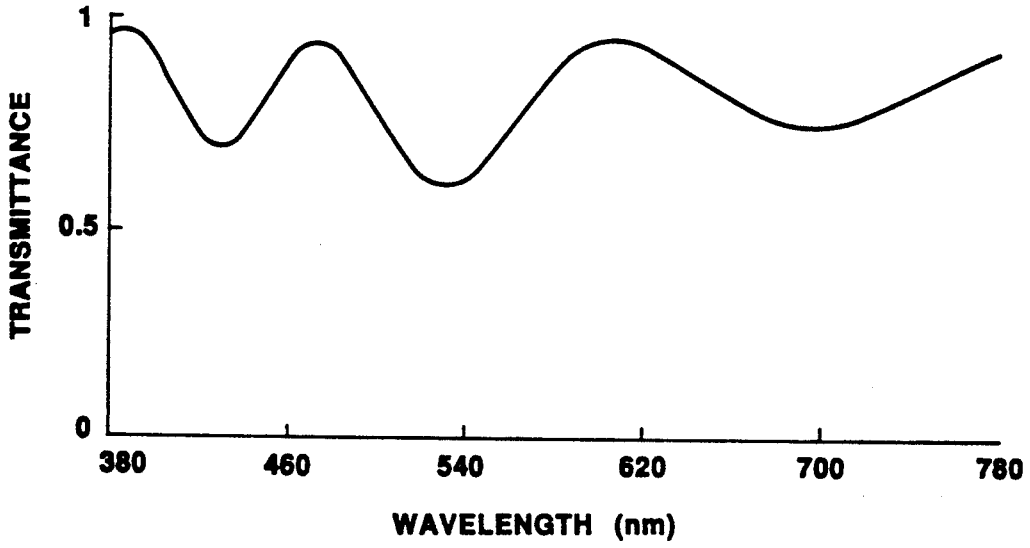
FIG. 4 is a graph showing transmittance of light rays passing through the light-filter film as a function of wavelength.

Transmittance of light rays passing through the light-filter film 22 as a function of wavelength is shown in FIG. 4. It is understood from FIG. 4 that transmittance of light rays of about 436 nm and about 546 nm wavelength are substantially low as compared with that of 578 nm wavelength. Therefore, the original bluish color of light rays which are radiated from the discharge bulb during the starting period is transformed into a white or at least whitish color by the light-film filter 22. Thus, according to the present invention, color rendition of the metal halide lamp device is improved. Furthermore, it is understood from FIG. 4 that light rays of about 480 nm wavelength is substantially high in transmittance. Therefore, as is mentioned above, intensity reduction of light rays due to the provision of the light-filter film 22 can be minimized during the steady state of the discharge bulb 10.

As compared with a conventional colored filter, the use of the light-filter film 22 makes it possible to easily decrease transmittance of light rays of a certain desired wavelength and to easily increase transmittance of light rays of another certain desired wavelength.

Figure 5:
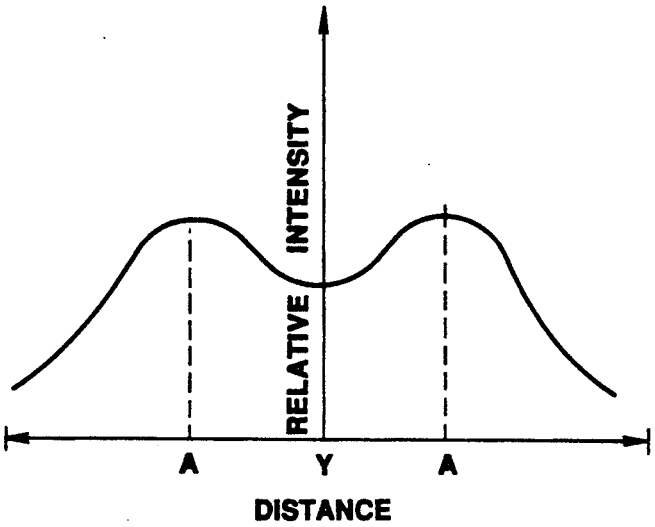
FIG. 5 is a graph showing relative intensity of light rays as a function of the distance from a central point "Y" of the light-filter film.

Depending on the shape of the discharge bulb 10, the position and the shape of the shade 18 and the like, with reference to FIGS. 2 and 5, relative intensity of light rays on a rear major surface of the light-filter film 22 varies as a function of the distance from a central point "Y" of the rear major surface of the light-filter film 22. In this case, the intensity takes a highest value at points "A" of the rear major surface of the light-filter film 22. When the incident angle of the light rays is "$\theta$" at the points "A", the light-filter film is constructed so as to satisfy the following equations (7) and (8) instead of satisfying the equations (1) and (2), thereby efficiently adjusting transmittance with respect to wavelength and thus improving color reduction of the metal halide lamp device of the present invention:

$$4\, n \cdot d / \lambda_a = 2\, k_0 \cdot \cos\theta \qquad (7)$$

$$4\, n \cdot d / \lambda_b = (2\, k_1 + 1) \cdot \cos\theta \qquad (8)$$

wherein, "d" represents thickness of the light-filter film, "n" represents refractive index of the light-filter film, "$\lambda_a$" represents wavelength of light rays of which transmittance is to be increased, "$\lambda_b$" represents wavelength of light rays of which transmittance is to be decreased, and "$k_0$" and "$k_1$" represent integers.

Thus, no condition that light rays incident on the light-filter film have an incident angle of $\theta$, the light-filter film according to the present invention is produced so as to allow the products of "n" and "d" to fall within one of three adjustment ranges from 890·cos θ nm to 1030·cos θ nm, from 1110·cos θ nm to 1290·cos θ nm, and from 1340·cos θ nm to 1540·cos θ nm.

If the light-filter film consists of plural layers, the light-filter film according to the present invention is produced as as to allow the sum of the products of thickness of each layer and refractive index of each layer falls within one of the three adjustment ranges from 890·cos θ nm to 1030·cos θ nm, from 1110·cos θ nm to 1290·cos θ nm, and from 1340·cos θ nm to 1540·cos θ nm on condition that light rays incident on the light-filter film have an incident angle of θ.

Figure 6:
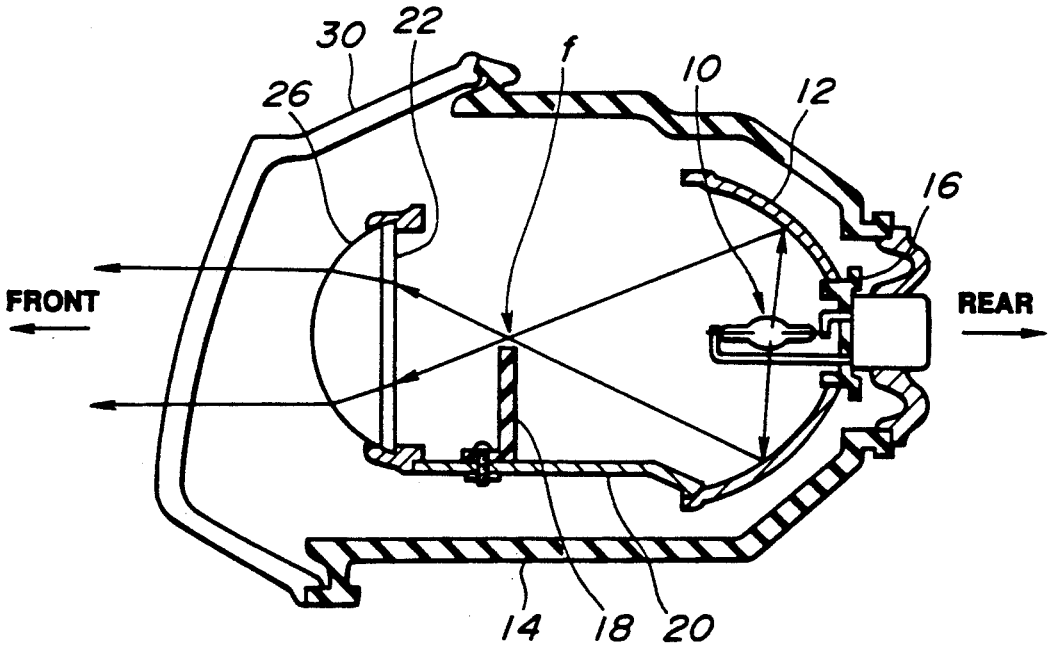
FIG. 6 is a view similar to FIG. 2, but showing a modification of the metal halide lamp device of the first embodiment.

As is seen from FIG. 6, if desired, the glass plate 24 which is shown in FIG. 1 may be omitted, and the light-filter film 22 may be directly formed on the converging lens 26.

Figure 7:
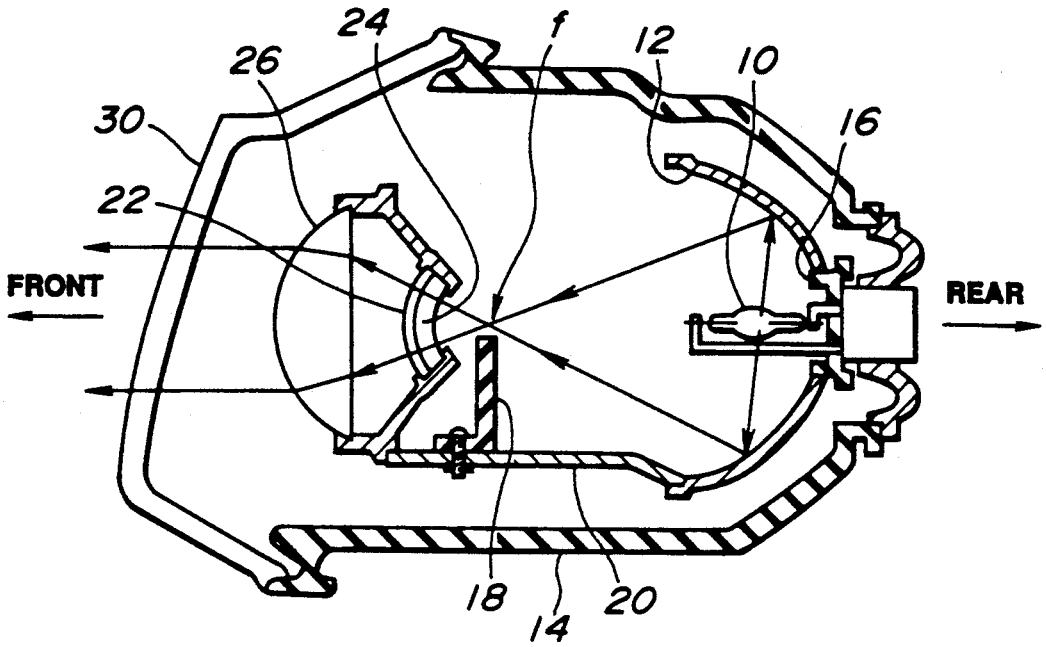
FIG. 7 is a view similar to FIG. 2, but showing another modification of the metal halide lamp device of the first embodiment.

Furthermore, as is seen from FIG. 7, if desired, the glass plate 24 and the light-filter film 22 may take a spherical shape so as to be concentric with each other and to have the focus "f" as a common center of spheres defined by the glass plate 24 and the light-filter film 22. In this case, majority of the light rays incident on the light-filter film 22 have an angle of 90° relative to the rear major surface of the light-filter film 22. Therefore, deviation of transmittance of light rays due to uneven incident angles can be substantially minimized.

Figure 8:
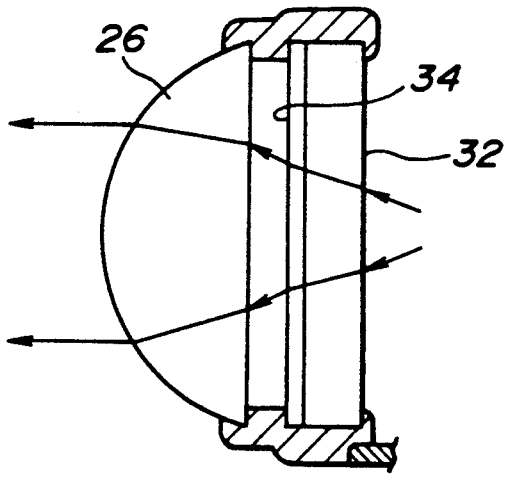
FIG. 8 is an enlarged sectional view showing a semi-transparent member and a light-filter film in accordance with a second embodiment of the present invention.
Figure 9:
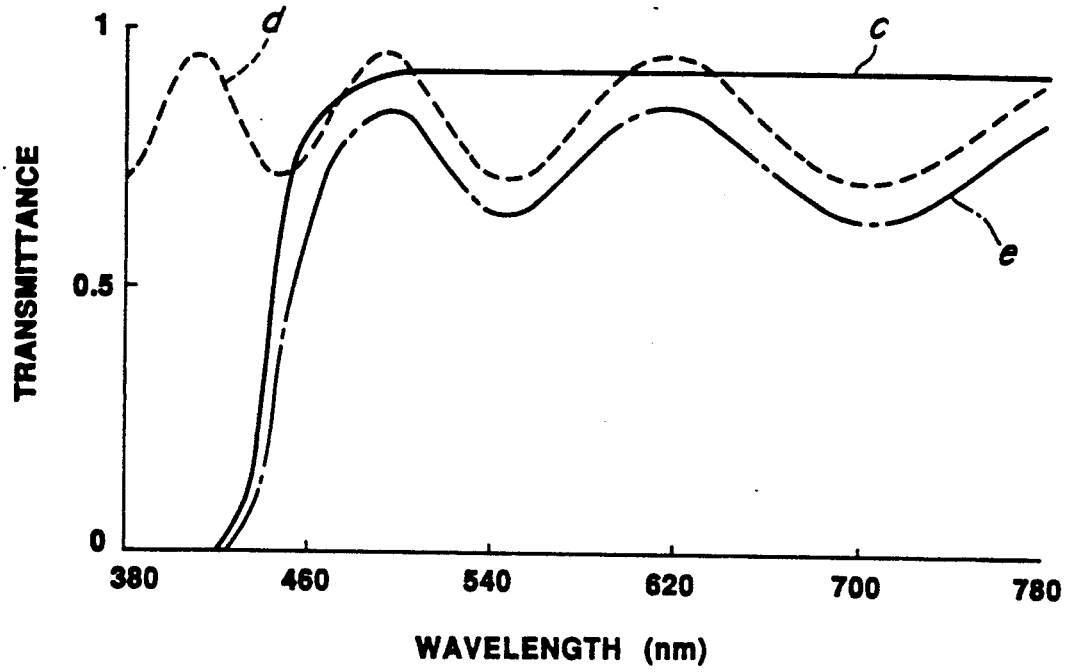
FIG. 9 is a graph showing transmittance of light rays passing through the semi-transparent member by a solid line "c", transmittance of light rays passing through the light-filter film of the second embodiment by a dotted line "d", and transmittance of light rays passing through both the semi-transparent member and the light-filter film of the second embodiment by a chain line "e"

Referring to FIGS. 8 and 9, a metal halide lamp device according to a second embodiment of the present invention will be described in the following. The second embodiment is a modification of the first embodiment.

There is provided a semi-transparent member 32 which is a high-pass filter or a sharp cut filter. A light-filter film 34 is formed on a front major surface of the semi-transparent member 32. The light-filter film 34 has substantially the same characteristics as those of the light-filter film 22 of the first embodiment.

As is shown by a solid line "c" of FIG. 9, the semi-transparent member 32 has a substantially high transmittance with respect to wavelength greater than about 460 nm and a substantially low transmittance with respect to wavelength shorter than about 460 nm. Therefore, it is understood that the semi-transparent member 32 is very efficient to remove light rays of 436 nm and to maintain a substantially high transmittance of light rays of 578 nm wavelength. In view of this, the light-filter film 34 is required to lower transmittance of light rays of 546 nm wavelength. Therefore, the light-filter film 34 is constructed so as to satisfy the following equation (9):

$$4n_3 \cdot d_3/546 = 2k_3 + 1 \quad (9)$$

wherein, "$d_3$" represents thickness of the light-filter film, "$n_3$" represents refractive index of the light-filter film, and "$k_3$" represents an integer.

Transmittance of light rays passing through the light-filter film 34 is shown by a dotted line "d" of FIG. 9. Thus, transmittance of light rays passing through both the semi-transparent member 32 and the light-filter film 34 are shown by a chain line "e" of FIG. 8.

As compared with the first embodiment, transmittance of light rays of 436 nm is more reduced by the provision of the semi-transparent member 32. Therefore, a bluish color during the starting period is more efficiently removed, and thus color rendition is more improved in the second embodiment.

Figure 10:
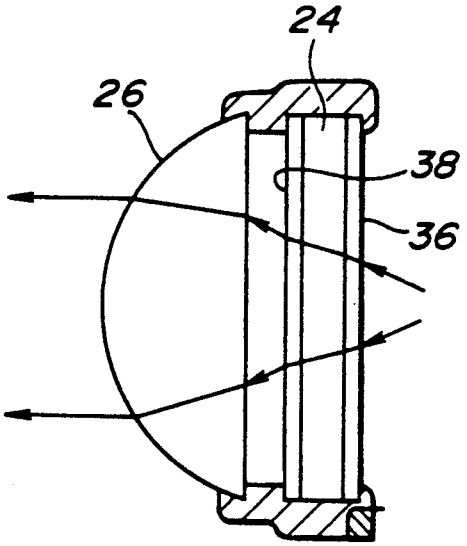
FIG. 10 is a view similar to FIG. 8, but showing a third embodiment of the present invention.

Referring to FIG. 10, a metal halide lamp device according to a third embodiment of the present invention will be described in the following. The third embodiment is another modification of the first embodiment.

In the third embodiment, there are provided first and second light-filter films 36 and 38 which have substantially the same characteristics as those of the light-filter film 22 of the first embodiment. The first and second light-filter films 36 and 38 are respectively formed on the front and rear major surfaces of the glass plate 24. The first and second light-filter films 36 and 38 are constructed so as to satisfy the following equations (10) and (11):

$$4n_4 \cdot d_4/546 = 2k_4 + 1 \quad (10)$$

$$4n_5 \cdot d_5/546 = 2k_5 + 1 \quad (11)$$

wherein, "$d_4$" and "$d_5$" represent thicknesses of the first and second light-filter films, "$n_4$" and "$n_5$" represent refractive indexes of the first and second light-filter films, and "$k_4$" and "$k_5$" represent integers.

Thus, similar to the light-filter film 22 of the first embodiment, the first and second light-filter films 36 and 38 have a substantially high transmittance with respect to 578 nm wavelength and a substantially low transmittance with respect 436 nm and 546 nm wavelength.

Thickness of the glass plate 24 is set to be in a range from about 1 mm to about 2 mm. Therefore, interference does not occur between light rays reflected from a boundary between the glass plate 24 and the second light-filter film 38, and light rays incident on a boundary between the glass plate 24 and the first light-filter film 36.

According to the third embodiment, transmittance of light rays of 436 nm is substantially reduced due to the provision of the first and second light-filter films 36 and 38. Thus, as compared with the first embodiment, a bluish color during the starting period is more efficiently removed, and thus color rendition of the metal halide lamp device is more improved in the third embodiment.

It is optional to make the glass plate 24 and the first and second light-filter films 36 and 38 of the third embodiment spherical in shape.

What is claimed is:

1. A metal halide lamp device comprising:

a discharge bulb containing therein mercury and at least one metal halide, said discharge bulb radiating light rays of a bluish color during a start-up period thereof, said light rays during the start-up period being predominantly emitted from said mercury and having a relative spectral distribution which is confined to discrete wavelengths of about 405 nm, about 436 nm, about 546 nm and about 578 nm; and a light filter which is so constructed such that transmittance of about 436 nm wavelength light rays passing through said light filter and transmittance of about 546 nm wavelength light rays passing therethrough are made lower than transmittance of about 578 nm wavelength light rays passing therethrough, thereby transforming said bluish color into a substantially white color by passing said light rays through said light filter.

2. A metal halide lamp device according to claim 1, wherein said light filter is so constructed such that said transmittances of about 436 nm and about 546 nm wavelength light-rays passing therethrough are made lower than transmittance of light rays passing therethrough of wavelength between about 436 nm and about 546 nm, thereby minimizing light intensity reduction during a steady state of said discharge bulb.

3. A metal halide lamp device according to claim 2, further comprising a semi-transparent member, said semi-transparent member being so constructed such that transmittance of light rays passing therethrough of wavelength shorter than about 436 nm is made lower than transmittance of light rays passing therethrough of wavelength greater than about 436 nm.

4. A metal halide lamp device according to claim 1, wherein said light filter is an interference filter.

5. A metal halide lamp device according to claim 1, wherein said light filter consists of a single or plural layers, and is so constructed such that the sum of the products of thickness of each layer and refractive index of said each layer falls within one selected from three ranges consisting of a first range between 890 nm and 1030 nm, a second range between 1110 nm and 1290 nm and a third range between 1340 nm and 1540 nm.

6. A metal halide lamp device according to claim 1, wherein said light filter is so constructed such that the products of thickness of said light filter and refractive index of said light filter falls within one selected from three ranges consisting of a first range between 890-cos $\theta$ nm and 1030-cos $\theta$ nm, a second range between 1110-cos $\theta$ nm and 1290-cos $\theta$ nm and a third range between 1340-cos $\theta$ nm and 1540-cos $\theta$ nm, where $\theta$ is the incident angle of light rays radiated from said discharge bulb to said light filter.

7. A metal halide lamp device according to claim 1, wherein said light filter consists of a single or plural layers, and is so constructed such that the sum of the products of thickness of each layer and refractive index of said each layer falls within one selected from three ranges consisting of a first range between 890-cos $\theta$ nm and 1030-cos $\theta$ nm, a second range between 1110-cos $\theta$ nm and 1290-cos $\theta$ nm and a third range between 1340-cos $\theta$ nm and 1540-cos $\theta$ nm, where $\theta$ is the incident angle of light rays radiated from said discharge bulb to said light filter.

8. A metal halide lamp device comprising:

a discharge bulb containing mercury and at least one metal halide for radiating light rays therefrom;

a reflector for reflecting said light rays directed to said reflector;

a light filter which is positioned so as to receive said light rays reflected from said reflector, said light filter being so constructed such that transmittance of about 436 nm wavelength light-rays passing therethrough and transmittance of about 546 nm wavelength light-rays passing therethrough are made lower than transmittance of about 578 nm wavelength light-rays passing therethrough.

9. A metal halide lamp device according to claim 8, wherein said reflector has a focus which is positioned between said light filter and said reflector, and wherein said light rays reflected from said reflector are converged at the focus and pass through said light filter.

10. A metal halide lamp device according to claim 9, wherein said light filter is flat in shape and arranged perpendicular to a central axis of said reflector.

11. A metal halide lamp device according to claim 9, wherein said light filter is spherical in shape and said focus is positioned at a center of a sphere defined by said light filter.

* * * * *